US008863538B2

(12) United States Patent
Hildebrand et al.

(10) Patent No.: US 8,863,538 B2
(45) Date of Patent: Oct. 21, 2014

(54) AMMONIA RECYCLING STILL FOR A REFRIGERATION SYSTEM AND METHOD THEREFOR

(75) Inventors: Lawrence F. Hildebrand, Fort Wayne, IN (US); Wayne Douglas Zollinger, Fort Wayne, IN (US)

(73) Assignee: Wagner-Meinert LLC, Fort Wayne, IN (US)

( * ) Notice: Subject to any disclaimer, the term of this patent is extended or adjusted under 35 U.S.C. 154(b) by 129 days.

(21) Appl. No.: 13/443,547

(22) Filed: Apr. 10, 2012

(65) Prior Publication Data

US 2012/0227827 A1 Sep. 13, 2012

Related U.S. Application Data

(62) Division of application No. 11/494,920, filed on Jul. 28, 2006, now abandoned.

(60) Provisional application No. 60/704,097, filed on Jul. 29, 2005.

(51) Int. Cl.

| | |
|---|---|
| ***F25B 43/04*** | (2006.01) |
| ***F25B 9/00*** | (2006.01) |
| ***F25B 45/00*** | (2006.01) |

(52) U.S. Cl.

CPC ..... *F25B 45/00* (2013.01); *F25B 2345/001* (2013.01); *F25B 2345/002* (2013.01); *F25B 9/002* (2013.01)

USPC ..... 62/195; 62/85; 62/303; 62/238.5; 62/149; 62/474; 62/475; 62/476; 62/77; 62/292

(58) Field of Classification Search

USPC ..... 62/85, 195, 303, 238.5, 149, 474, 475, 62/476, 77, 292

See application file for complete search history.

(56) References Cited

U.S. PATENT DOCUMENTS

| | | | | | |
|---|---|---|---|---|---|
| 3,478,529 | A | * | 11/1969 | Boykin | 62/85 |
| 4,646,527 | A | * | 3/1987 | Taylor | 62/85 |
| 5,127,232 | A | | 7/1992 | Paige et al. | |
| 5,243,831 | A | | 9/1993 | Major et al. | |
| 5,433,081 | A | * | 7/1995 | Major et al. | 62/85 |
| 5,471,848 | A | * | 12/1995 | Major et al. | 62/149 |
| 5,603,223 | A | * | 2/1997 | Murray et al. | 62/84 |
| 5,761,924 | A | * | 6/1998 | Peckjian | 62/292 |
| 6,260,378 | B1 | * | 7/2001 | Sagar | 62/475 |
| 6,826,925 | B2 | * | 12/2004 | Renders | 62/475 |

* cited by examiner

*Primary Examiner* — Frantz Jules
*Assistant Examiner* — Azim Abdur Rahim
(74) *Attorney, Agent, or Firm* — Taylor IP, P.C.

(57) ABSTRACT

A method of treating a contaminated refrigeration fluid including the steps of transferring, separating, returning, moving and removing. The transferring step includes the transferring of a portion of the contaminated refrigeration fluid from a refrigeration system to a first tank. The separating step includes the separating of refrigerant from the portion of the contaminated refrigeration fluid resulting in the refrigerant and a refrigerant depleted portion. The returning step includes the returning of the refrigerant to the refrigeration system. The moving step includes the moving of the refrigerant depleted portion to a second tank. The removing step includes the removing of oil from the refrigerant depleted portion.

16 Claims, 4 Drawing Sheets

AMMONIA RECYCLING STILL FOR A REFRIGERATION SYSTEM AND METHOD THEREFOR

CROSS REFERENCE TO RELATED APPLICATIONS

This is a division of U.S. patent application Ser. No. 11/494,920, entitled "AMMONIA RECYCLING STILL FOR A REFRIGERATION SYSTEM AND METHOD THERFOR", filed Jul. 28, 2006, which is incorporated herein by reference. U.S. patent application Ser. No. 11/494,920 is a non-provisional application based upon U.S. provisional patent application Ser. No. 60/704,097, entitled "AMMONIA RECYCLING STILL FOR A REFRIGERATION SYSTEM AND METHOD THEREFOR", filed Jul. 29, 2005.

BACKGROUND OF THE INVENTION

1. Field of the Invention

The present invention relates to an ammonia still apparatus and method for purifying ammonia from contaminated refrigeration fluid.

2. Description of the Related Art

In the classic compression type refrigeration system, a refrigerant is alternately compressed and expanded. In a simple closed loop compression type refrigeration system, there is at least a compressor, an evaporator, a throttling or metering device, and a condenser. During one stage of the compression type refrigeration cycle, a low pressure refrigerant vapor enters the compressor. At this point in the cycle, work is required of the compressor in. order to raise the pressure and the boiling point of the refrigerant vapor. In the next phase of the compression type refrigeration cycle, the high pressure, high temperature refrigerant vapor leaving the compressor is transferred through a heat exchanger called a condenser. A second fluid passes through the condenser in order to remove heat from the refrigerant vapor, thereby transforming the refrigerant vapor to a refrigerant liquid. As the refrigerant liquid exits the condenser, it leaves at the same pressure but at a lower temperature than it had upon entering the condenser.

Next, the refrigerant passes through a throttling device that reduces the pressure, temperature and boiling point of the fluid. In the last step of the typical compression type refrigeration cycle, refrigerant travels through an evaporator to receive heat from some other fluid in communication with the evaporator to achieve the desired cooling effect of this other fluid. Such a closed loop compression refrigeration cycle is duplicated in order to repetitively remove heat from a body of fluid in communication with the evaporator.

Commercial and industrial refrigeration systems typically use anhydrous ammonia. Anhydrous ammonia is the liquid form of pure ammonia gas and is technically water-free. Most refrigeration experts consider industrial grade anhydrous ammonia to be the most economical and efficient heat transfer medium for industrial refrigeration processes.

Water, unfortunately, finds its way into the refrigeration system, and over time, accumulates to a level of concern. Ammonia readily associates with water to form ammonium hydroxide, an inferior refrigerant that reduces the efficiency of the refrigeration system. The reduced efficiency increases the use of energy consumed in the system, thus increasing the cost of operation and also accelerates wear and tear on equipment causing shorter mean time to failure.

In an industrial refrigeration system, compressors, piping, and vessels containing anhydrous ammonia are prevalent throughout the refrigeration plant. Such a refrigeration system generally has lubricating oils inserted into the compressor for lubrication. Invariably, some of the oil or other lubricant migrates throughout the system, mixing with the anhydrous ammonia. Since the oil serves as an insulator or retardant to heat transfer, a high prevalence of waste oil in a refrigeration system compromises the efficiency of the refrigeration process. In addition, chemical reactions can occur between the oil, ammonia and/or water to produce additional waste products, such as sludge and acids. The addition of oil and water to ammonia can also provide a rich medium for microbiological growth which can produce slime and acids to further degrade the efficiency of operation as well as physically damage the system.

In order to prevent deterioration of the refrigeration efficiency as well as the physical parts of the system, accumulations of waste lubricating oil and water need to be purged from the system. Most commercial and industrial refrigeration units include one or more ports located at a lower level in the piping system and arranged such that lubricating oil will accumulate there to be drained from the pipes for collection and/or discarding. Unfortunately, the ammonia is wasted in these systems.

Therefore a need exists to purify and recycle ammonia in a refrigeration system from waste fluid having waste oil and water contaminants while preventing the undesirable side effects associated with draining waste fluid.

SUMMARY OF THE INVENTION

The present invention, in one form, consists of a method of treating a contaminated refrigeration fluid including the steps of transferring, separating, returning, moving and removing. The transferring step includes the transferring of a portion of the contaminated refrigeration fluid from a refrigeration system to a first tank. The separating step includes the separating of refrigerant from the portion of the contaminated refrigeration fluid resulting in the refrigerant and a refrigerant depleted portion. The returning step includes the returning of the refrigerant to the refrigeration system. The moving step includes the moving of the refrigerant depleted portion to a second tank. The removing step includes the removing of oil from the refrigerant depleted portion.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

Figure 1:
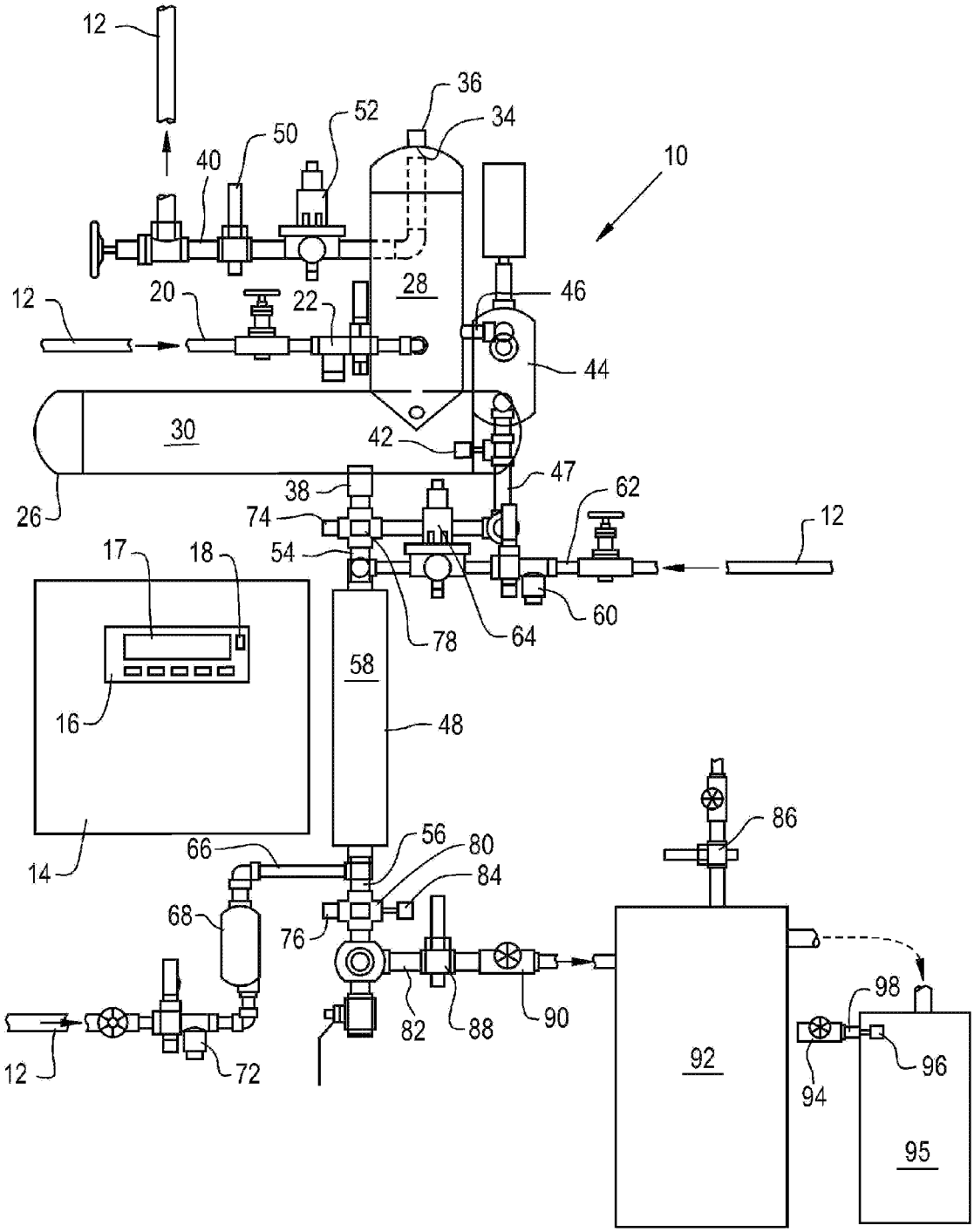
FIG. 1 is front plan view of the ammonia still apparatus of the invention with the electrical lines removed for easier viewing.
Figure 2:
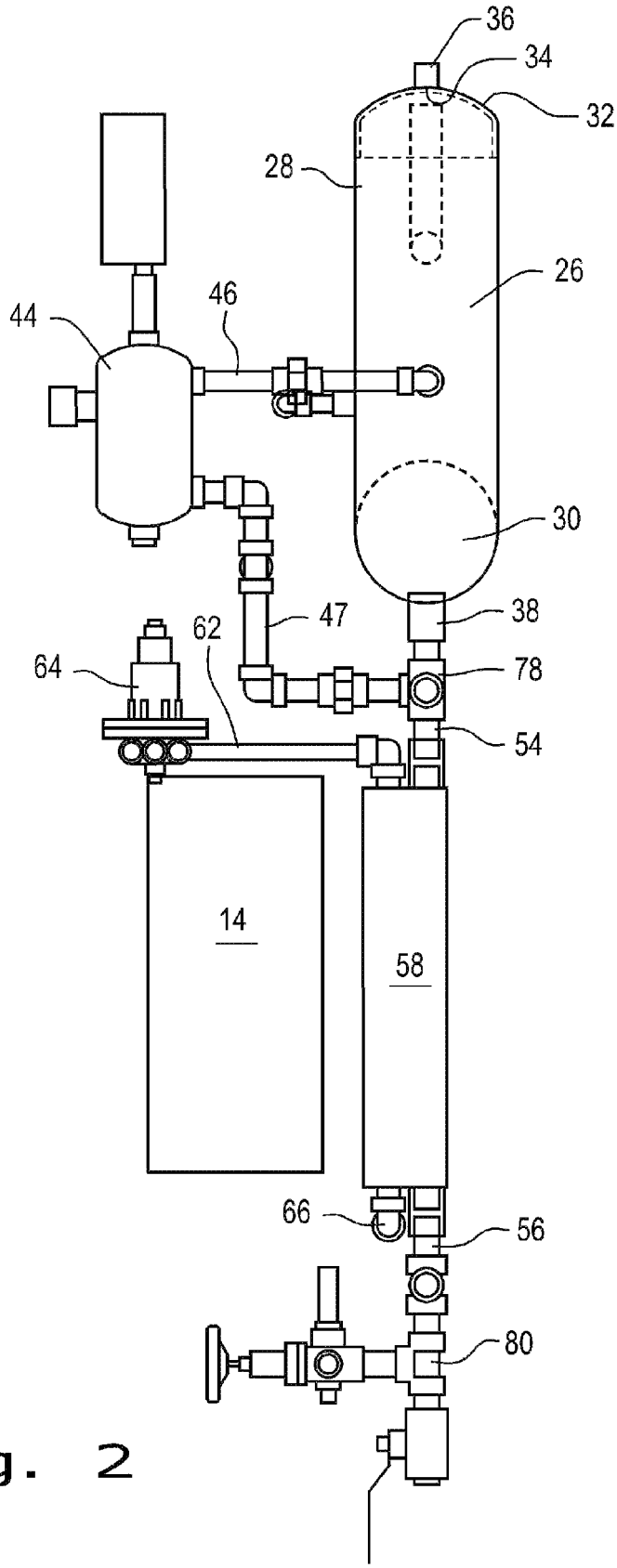
FIG. 2 is a side plan view of the ammonia still apparatus of the invention with the electrical lines removed for easier viewing.
Figure 3:
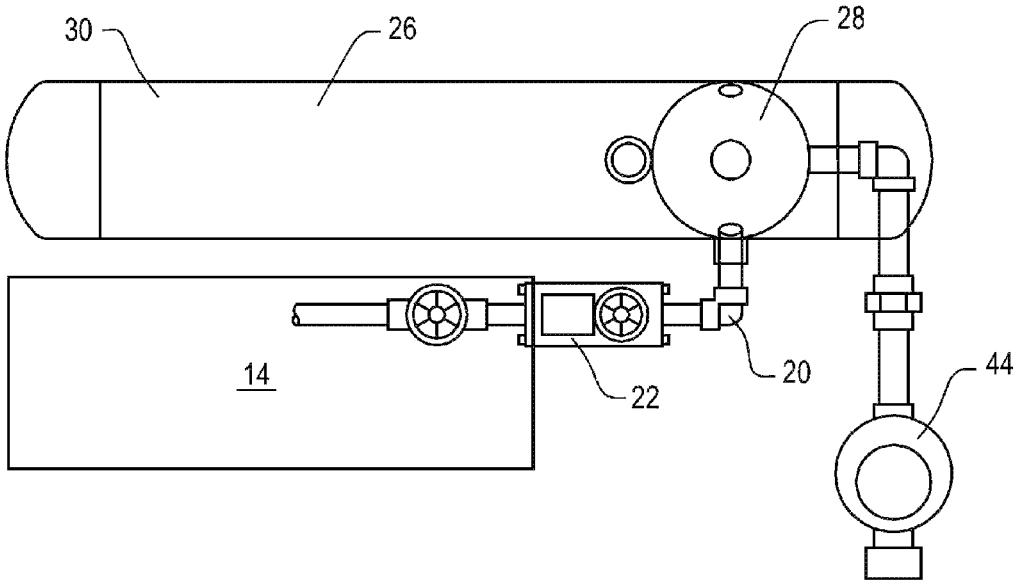
FIG. 3 is a top plan view of the ammonia still apparatus of the invention with the ammonia discharge line removed.
Figure 4:
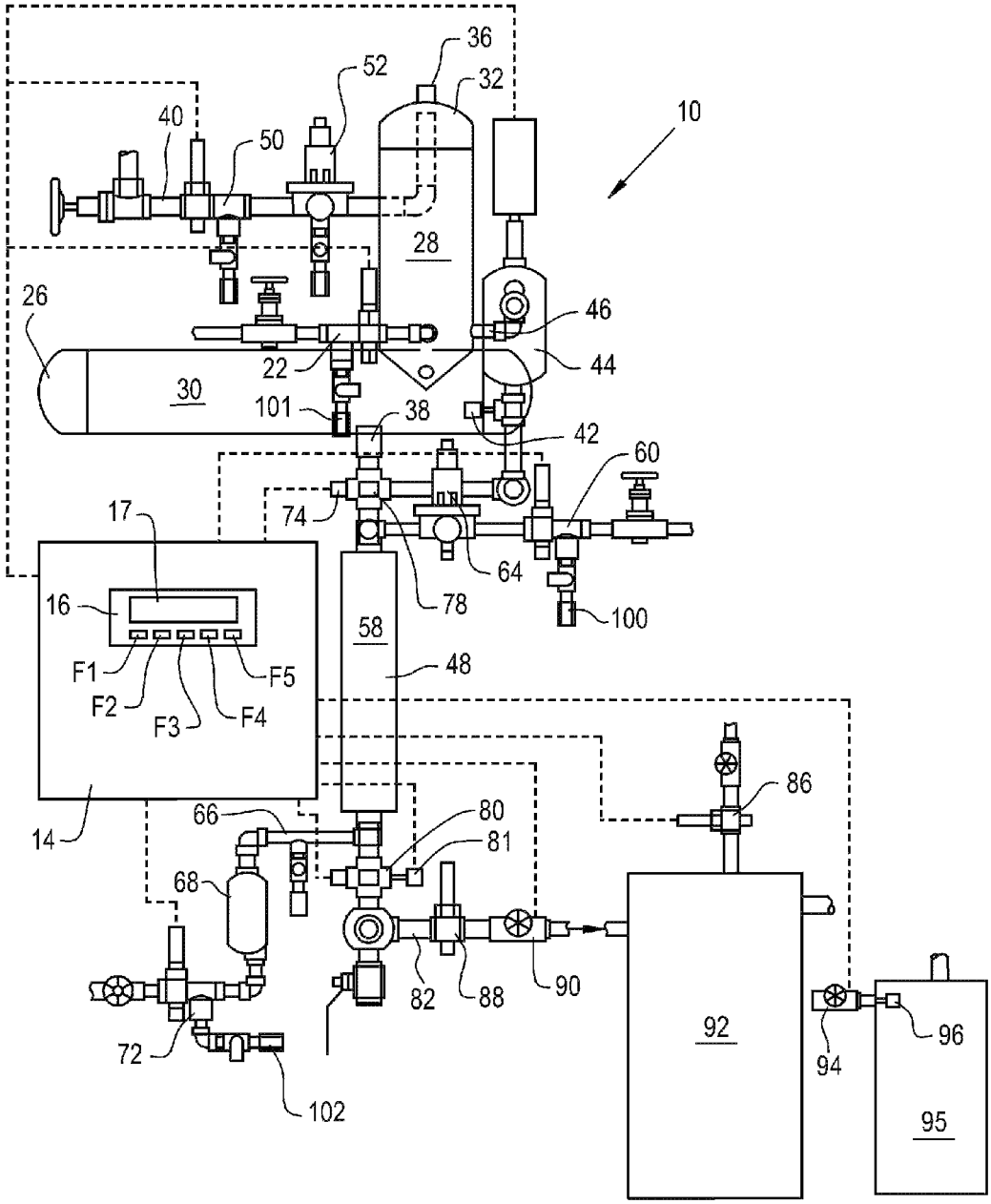
FIG. 4 is a side plan view of the ammonia still apparatus of the invention with additional valves for access to the apparatus and electrical lines drawn schematically.

Corresponding reference characters indicate corresponding parts throughout the several views. The exemplification (s) set out herein illustrate(s) (one) embodiment(s) of the invention (, in one form,) and such exemplification(s) (is)(are) not to be construed as limiting the scope of the invention in any manner.

DETAILED DESCRIPTION OF THE INVENTION

Turning to the Figures, where like reference numerals refer to like structures, an ammonia still apparatus 10 of the invention is used to purify and recycle anhydrous ammonia from contaminated ammonia refrigerant fluid. The ammonia still apparatus 10 is in fluid communication with an ammonia refrigeration system 12 and can be used manually with or without an electronic controller, such as a programmable logic controller (PLC) 14 to control the operations of the ammonia still apparatus 10. The PLC 14 is communication with the ammonia still apparatus 10 and is preferably part of the ammonia still apparatus 10, although the PLC 14 can be installed in another location and wired to the ammonia still apparatus 10.

During manual operation with the PLC 14, a solenoid energizes to open a valve immediately in response to a pushbutton input from the control panel 16 of the PLC 14, once a particular function is selected. In this disclosure, the term "solenoid" is used to refer to a solenoid or the combination of the solenoid and the valve the solenoid controls. Upon release of the pushbuttons, the solenoid de-energizes and the valve closes.

The PLC 14 can be programmed to control the solenoids in the ammonia still apparatus 10. The PLC 14, for example, can be programmed to have the following functions in response to the input from particular programmed function keys. For example, F1 is programmed to energize a suction solenoid 50. F2 is programmed to energize the liquid solenoid 22. F3 is programmed to energize a hot gas solenoid 60. F4 is programmed to energize a discharge solenoid 72. F5 is programmed to energize a water dump solenoid 88.

The solenoids open immediately in response to switching a selector switch 18 on the front of the control panel 16 from manual operation to automatic operation. Once in automatic operation, the suction solenoid 50 and liquid solenoid 22 energize and their valves open. Contaminated ammonia refrigerant fluid flows from the ammonia refrigeration system 12 through a liquid inlet 20 into a tank 26. The liquid inlet 20 has a liquid solenoid 22, preferably with a strainer, that controls the flow of contaminated fluid into the ammonia still apparatus 10.

The tank 26 has an upper tank 28, such as a vertical pipe, in fluid communication with the liquid inlet 20, an ammonia line 40 and a lower tank 30, such as a horizontal pipe. The upper tank 28 can have a cap 32 covering the top with an upper opening 34 for receiving a plug 36 or a safety relief valve. At the bottom of the lower tank 30 is a tank outlet 38. If desired, the tank 26 can be insulated.

Contaminated ammonia refrigerant fluid flowing into the tank 26 can be measured with an upper liquid sensor 42, such as a float switch 44. The float switch 44 is in communication with the PLC 14 and in fluid communication with the tank 26. The contaminated fluid level in the tank 26 rises until reaching a set maximum level. Then the float switch 44 signals to the PLC 14 that the contaminated fluid is at the maximum level. The PLC 14 de-energizes the liquid solenoid 22 and closes its valve to stop the flow of contaminated fluid into the tank 26. The suction solenoid 50 remains energized and open.

The float switch 44 has an upper float line 46 and a lower float line 47. The upper float line 46 is in fluid communication with the upper tank 28. The lower float line 47 is in fluid communication with the tank outlet 38: When the contaminated fluid level in the tank 26 rises, a float rod in the float switch 44 also rises until reaching the maximum fluid level. At the maximum fluid level, the float switch 44 signals the PLC 14 and switches off the flow of contaminated fluid into the tank 26.

As soon as the liquid solenoid 22 de-energizes and closes, the PLC 14 activates a heat exchanger 48 in fluid communication with the tank 26. The heat exchanger 48 has a heat exchanger fluid inlet 54 and a waste fluid outlet 56 at the opposite end for discharging waste fluid, such as water and oil. The heat exchanger 48 heats the contaminated fluid from the tank 26 to boil off anhydrous ammonia. The heat exchanger 48 should maintain a temperature of about 60° F., but can be set at a temperature range of about 0° F. to about 100° F., with a preferable range of about 60° F. to about 65° F. Once reaching the boiling point of ammonia, anhydrous ammonia boils and separates from the heated contaminated fluid. The anhydrous ammonia passes upward through the contaminated fluid and back into the tank 26. The anhydrous ammonia discharges from the tank 26 through the ammonia discharge line 40 and back into the refrigeration system 12 where it is reused. The ammonia discharge line 40 has the suction solenoid valve 50 which opens to allow the anhydrous ammonia out of the ammonia still apparatus 10. An ammonia regulator 52 in the ammonia discharge line 40 can control the pressure of the anhydrous ammonia.

The heat exchanger 48 is preferably a fluid heat exchanger 58 using hot gas, such as ammonia, available from the plant to heat the contaminated fluid. The PLC 14 energizes a hot gas solenoid 60 and its valve opens to allow hot gas to flow through the hot gas inlet 62 into the heat exchanger 58. A hot gas regulator 64 can control the pressure in the hot gas inlet 62, typically between about 100 psi to about 120 psi.

The hot gas heats the contaminated fluid, and in doing so, cools and can condense. The condensate flows out of the heat exchanger 58 though a discharge outlet 66. The discharge outlet 66 can have a drain trap 68 leading to a drain 70 in fluid communication with the plant. A discharge solenoid 72 communicates with the PLC 14, which controls the energizing of the discharge solenoid 72 and the opening of its valve to return liquid condensate to the plant.

Upper and lower temperature sensors 74, 76 are located at opposite ends of the heat exchanger 54. The temperature sensors 74, 76 measure the temperature of the fluid at both ends of the heat exchanger 54 and communicate the measured temperatures to the PLC 14. The upper temperature sensor 74 measures the upper temperature of the contaminated fluid between the tank 26 and the heat exchanger 54, such as at a first fitting 78 connecting the tank outlet 38, a heat exchanger fluid inlet 54 and the lower float line 47. The lower temperature sensor 76 measures the lower temperature of the waste fluid discharged from the heat exchanger 54, preferably at a second fitting 80 connecting the waste fluid outlet 56 with a water/oil discharge line 82 and a lower liquid sensor 84, such as a liquid switch 81.

If the lower temperature sensor 76 and the upper temperature sensor 74 signal the PLC 14 that the temperatures of the contaminated fluid and the waste fluid have reached the temperature set point (which can be shown on the PLC 14 display screen) but the tank fluid level in the tank 26 has not reached the set maximum tank fluid level measured by the upper liquid sensor 42, the system repeats the process from the beginning. Alternatively, if the upper and lower temperature sensors 74, 76 are not equal and the tank fluid level in the tank 26 has not reached the set maximum level, the cycle restarts. To restart the cycle, the hot gas solenoid 60 and the discharge solenoid 72 de-energize and close while the liquid solenoid 22 energizes and opens again until the tank fluid level in the tank 26 reaches the maximum level.

The system repeats the cycle until the upper and lower temperature sensors 74, 76 signal the PLC 14 that the upper and lower temperatures are equal. Once the upper and lower temperatures are equal and the tank fluid level in the tank 26 reaches the upper level switch 42, the ammonia still apparatus 10 is ready to discharge the waste fluid which has been collecting.

At this point, the PLC 14 signals the hot gas solenoid 60, the suction solenoid 50 and the discharge solenoid 72 to de-energize and close. The water fill solenoid 86 for an oil skimmer tank 92 now energizes and opens its valve to send fresh water into the oil skimmer tank 92. After a period of time, such as five minutes, the waste dump solenoid 88 energizes and opens its valve to dump the waste fluid into the oil skimmer tank 92 and the suction solenoid 50 de-energizes and closes. The water fill solenoid 86 remains energized during this time. A flow meter 90 measures the flow of the waste fluid from the ammonia still apparatus 10 and an associated throttling valve can regulate the rate of flow.

When the lower liquid sensor 84 for the water dump reaches its set lower waste fluid level point, the lower liquid sensor 84 sends a signal back to the PLC 14. The PLC 14 signals the water dump solenoid 88 and water fill solenoid 86 to de-energize and close. The cycle begins again by energizing and opening the suction and liquid solenoids 50, 22.

In the oil skimmer tank 92, the oil is allowed to separate from the water. Fresh water can flow into the oil skimmer tank 92 to help dilute any remaining ammonia by absorbing it into a larger mass of water and preventing undesirable odor in the installed location. The separated oil is drawn off into an oil receiver 95, such as a bucket. An oil flow meter 94 in fluid communication with the oil line 98 can measure the amount of oil collected and send the measured amount to the PLC 14. An oil level sensor switch 96 in communication with the PLC 14 could also be used to turn off the ammonia still apparatus 10 if the oil receiver 94 is filled. The separated oil can then be collected and disposed separately from the water.

The number of gallons of water dumped from the system is displayed on the display screen of the PLC 14. Alternatively, the number of gallons dumped can be sent to a networked computer or printer, as well as other data which can be collected, such as temperature and pressure.

The PLC can be programmed from the control panel in the program mode or run in a previously programmed mode. The PLC can also be part of a computer network and can be remotely programmed from the network. The program mode allows maximum flexibility to alter the parameters of the system to match the conditions of the plant and fluid. The PLC can also be programmed to draw fluid from different points in the refrigeration system. The run mode allows the continuous running of the ammonia still apparatus of the invention without requiring an operator to monitor and dump out the system. This also allows the ammonia still apparatus to run while providing shut-offs and safeguards to the system.

The display screen can constantly show the upper and lower sensor temperatures, the number of gallons of water dumped from the system and the temperature set point. The temperature set point is the same for both the upper and lower sensors. Once the system is in the run mode, the display screen can show the current conditions of the system, such as the upper and lower temperatures, the temperature set point and the gallons of water produced.

Regulators can be used in the hot gas and ammonia lines to control pressure if desired. Pressure sensors can also be used to send feed back to the PLC 14 and monitor the pressure in the system. Additional valves 100, 101, 102 can be used in the lines for additional access to the ammonia still apparatus for safety.

The ammonia still apparatus of the invention allows the ammonia refrigerant to be purified over time for greater efficiency in the operation of the refrigeration system. As a result, the refrigeration system requires fewer compressors, smaller equipment and higher pressures to maintain adequate temperatures in the facility. This greatly decreases energy costs and other expenses, such as system cleaning and pipe replacement, and reduces wear and tear on the equipment.

While the invention is shown in only one of its forms, it is not thus limited but is susceptible to various changes and modifications without departing from the spirit and scope of the invention.

What is claimed is:

1. A method of purifying ammonia from contaminated refrigeration fluid in an ammonia refrigeration system, the method comprising the steps of:
(a) allowing contaminated refrigeration fluid from the refrigeration system to flow into a tank;
(b) heating the contaminated refrigeration fluid in the tank with a heat exchanger and preventing further contaminated refrigeration fluid from flowing into the tank during the heating step;
(c) measuring the contaminated refrigeration fluid level in the tank;
(d) separating anhydrous ammonia from the contaminated refrigeration fluid;
(e) removing the separated anhydrous ammonia;
(f) returning the removed anhydrous ammonia from the tank to the ammonia refrigeration system;
(g) measuring an upper temperature of the contaminated refrigeration fluid between the tank and the heat exchanger;
(h) measuring a lower temperature of the waste fluid after leaving the heat exchanger;
(i) measuring a tank fluid level in the tank;
(j) discharging waste fluid from the heat exchanger once the upper temperature and the lower temperature are equal and the tank fluid level reaches a set maximum tank fluid level; and
(k) preventing contaminated refrigeration fluid from flowing into the tank and anhydrous ammonia from leaving the tank during the discharge of waste fluid.

2. The method of purifying ammonia from contaminated refrigeration fluid in an ammonia refrigeration system of claim 1, further comprising the steps of
(l) measuring a waste fluid level of the waste fluid after leaving the heat exchanger; and
(m) preventing the waste fluid from discharging once the waste fluid level reaches a set lower waste fluid level point.

3. The method of purifying ammonia from contaminated refrigeration fluid in an ammonia refrigeration system of claim 2, further comprising the steps of:
(n) collecting the waste fluid in an oil skimmer tank;
(o) separating oil and water from the waste fluid;
(p) removing the oil; and
(q) removing the water.

4. The method of purifying ammonia from contaminated refrigeration fluid in an ammonia refrigeration system of claim 2, further comprising the steps of:
(n) circulating hot gas in the heat exchanger;
(o) discharging hot gas condensate from the heat exchanger; and (p) preventing hot gas from circulating and hot gas condensate from discharging during the discharge of waste fluid.

5. A method of purifying ammonia from contaminated refrigeration fluid within an ammonia refrigeration system, the method comprising the steps of:

(a) opening a liquid solenoid and allowing the contaminated refrigeration fluid to flow into a tank from the refrigeration system;

(b) opening a suction solenoid and allowing anhydrous ammonia to flow from the tank into the ammonia refrigeration system;

(c) measuring a tank fluid level of the contaminated refrigeration fluid level within the tank with an upper liquid sensor;

(d) communicating the measured tank fluid level to a Programmable Logic Controller (PLC);

(e) heating contaminated refrigeration fluid from the tank with a heat exchanger;

(f) closing the liquid solenoid during heating with the heat exchanger;

(g) separating anhydrous ammonia from the contaminated refrigeration fluid in the heat exchanger;

(h) sending the separated anhydrous ammonia into the refrigeration system;

(i) measuring an upper temperature of the contaminated refrigeration fluid between the tank and the heat exchanger;

(j) measuring a lower temperature of the waste fluid after leaving the heat exchanger;

(k) communicating the measured upper and lower temperatures to the PLC; (I) measuring a waste fluid level of the waste fluid with a lower liquid sensor communicating with the PLC; and (m) opening a waste dump solenoid and discharging waste fluid from the heat exchanger after the upper and lower temperatures are equal and the tank level reaches a maximum tank level;

(n) closing the liquid solenoid and the suction solenoid during waste fluid removal; and (o) wherein the PLC communicates with at least one of the solenoids to open and close the solenoids.

6. The method of purifying ammonia from contaminated refrigeration fluid in an ammonia refrigeration system of claim 5, further comprising the steps of (p) measuring a waste fluid level of the waste fluid after leaving the heat exchanger; and (q) closing the waste dump solenoid once the waste fluid level reaches a set lower waste fluid level point.

7. The method of purifying ammonia from contaminated refrigeration fluid in an ammonia refrigeration system of claim 6, further comprising the steps of:

(r) collecting waste fluid in an oil skimmer tank;

(s) separating oil and water from the waste fluid;

(t) removing the oil; and (u) removing the water.

8. The method of purifying ammonia from contaminated refrigeration fluid in an ammonia refrigeration system of claim 6, further comprising the steps of:

(r) opening a hot gas solenoid;

(s) circulating hot gas in the heat exchanger;

(t) opening a discharge solenoid to dispose of condensate from the heat exchanger; and (u) closing the hot gas and discharge solenoids during waste fluid removal.

9. A method of treating a contaminated refrigeration fluid, comprising the steps of:

transferring a portion of said contaminated refrigeration fluid from a refrigeration system to a first tank;

separating refrigerant from said portion of said contaminated refrigeration fluid resulting in said refrigerant and a refrigerant depleted portion;

returning said refrigerant to said refrigeration system;

moving said refrigerant depleted portion to a second tank;

removing oil from said refrigerant depleted portion; and adding water to said refrigerant depleted portion in said second tank.

10. The method of claim 9, further comprising the steps of:

disposing of said oil; and disposing of said water.

11. The method of claim 9, wherein said separating step includes the step of heating said portion of said contaminated refrigeration fluid to boil out said refrigerant.

12. The method of claim 11, wherein said heating step is carried out with a heat exchanger.

13. A method of treating a contaminated refrigeration fluid, comprising the steps of:

transferring a portion of said contaminated refrigeration fluid from a refrigeration system to a first tank;

separating refrigerant from said portion of said contaminated refrigeration fluid resulting in said refrigerant and a refrigerant depleted portion;

returning said refrigerant to said refrigeration system;

moving said refrigerant depleted portion to a second tank; and removing oil from said refrigerant depleted portion, said separating step includes the step of heating said portion of said contaminated refrigeration fluid to boil out said refrigerant, said heating step being carried out with a heat exchanger, said heat exchanger has at least two temperature sensors associated therewith including an upper temperature sensor and a lower temperature sensor, said transferring step, said separating step, and said returning step being repeated if a measured level of said fluid in said first tank is less than a predetermined level and said upper temperature sensor and said lower temperature sensor do not indicate an equal temperature.

14. A method of treating a contaminated refrigeration fluid, comprising the steps of:

transferring a portion of said contaminated refrigeration fluid from a refrigeration system to a first tank;

separating refrigerant from said portion of said contaminated refrigeration fluid resulting in said refrigerant and a refrigerant depleted portion;

returning said refrigerant to said refrigeration system;

moving said refrigerant depleted portion to a second tank; and removing oil from said refrigerant depleted portion, said transferring step, said separating step, and said returning step are repeated if a measured level of said fluid in said first tank is less than a predetermined level.

15. The method of claim 14, wherein said moving step is carried out after carrying out said returning step and when said measured level is at least at said predetermined level.

16. The method of claim 9, wherein said removing step is carried out in said second tank while said transferring step, said separating step, and said returning step are being carried out in said first tank.

* * * * *